United States Patent [19]

Croser

[11] Patent Number: 4,813,565

[45] Date of Patent: Mar. 21, 1989

[54] WINE CASK

[75] Inventor: Brian J. Croser, Piccadilly, Australia

[73] Assignee: Wine Technologies (S.A.) Ltd., Australia

[21] Appl. No.: 934,648

[22] Filed: Nov. 25, 1986

[30] Foreign Application Priority Data

Nov. 26, 1985 [AU] Australia ..... PH3575

[51] Int. Cl.[4] ..... B65D 43/00

[52] U.S. Cl. ..... 217/88; 220/327

[58] Field of Search ..... 217/88, 91, 94; 220/327

[56] References Cited

U.S. PATENT DOCUMENTS

| | | | |
|---|---|---|---|
| 825,878 | 7/1906 | Crandal | 217/88 |
| 1,010,080 | 11/1911 | Shreve | 217/88 |
| 1,976,173 | 10/1934 | Hutchings | 217/88 |
| 2,050,461 | 8/1936 | Perry | 217/88 |
| 2,241,210 | 5/1941 | Luckett | 217/88 |
| 2,649,124 | 8/1953 | Merron | 217/88 |
| 3,116,034 | 12/1963 | Randolph | 217/88 |
| 3,279,645 | 10/1966 | Harvey | 220/327 |
| 3,454,184 | 7/1969 | Halpin | 220/327 |

*Primary Examiner*—Joseph Man-Fu Moy

*Attorney, Agent, or Firm*—Klauber & Jackson

[57] ABSTRACT

A wine cask has a circular metal base and a circular metal end cover. A plurality of staves arranged circumferentially and lying edge to edge are clamped by a circumferential clamp which retains them in a cylindrical configuration and a tension clamp extends in an axial direction between the base and end cover and clamps the staves between them.

10 Claims, 2 Drawing Sheets

FIG 3
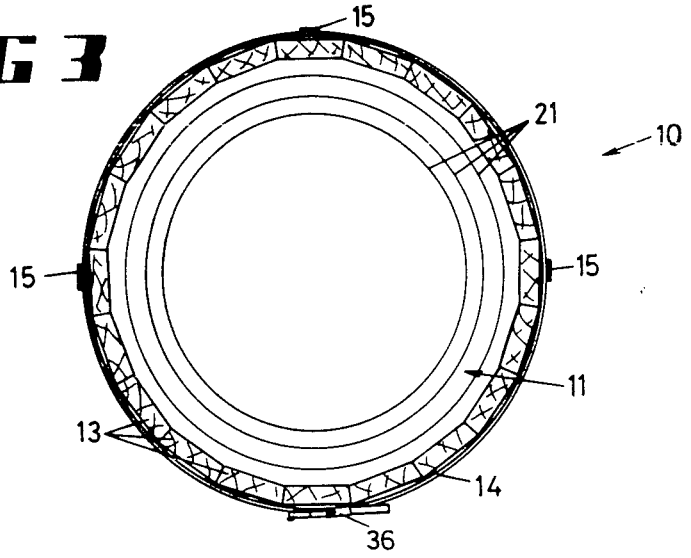
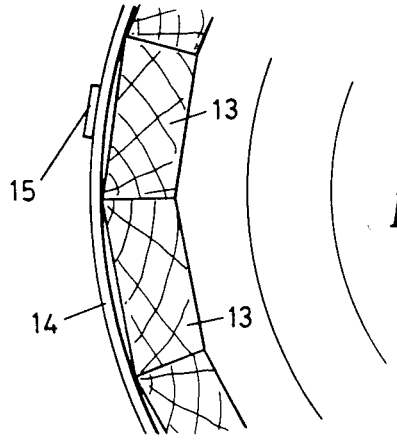
FIG 4
FIG 5
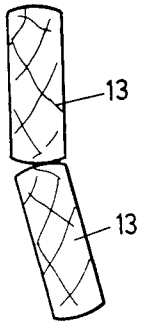
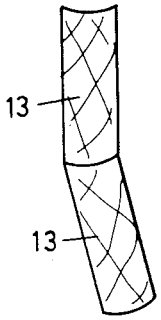
FIG 6

WINE CASK

This invention relates to a wine cask which is suitable for containing wine which requires to be aged in wood of a specified type.

BACKGROUND OF THE INVENTION

Most wines are aged in French oak or American oak, but some other woods can be specified for certain types of wine. There is a tannin flavour which is imparted by wood phenolics to the wine and this is traditionally acceptable, and consequently there is a requirement for large quantities of the appropriate timber. If casks are to be made by the usual cooperage methods, then not only is there an extensive use of available time but also the usage of timber is excessive and therefore a cask made with staves of French or American oak by traditional cooperage methods is excessively expensive.

PRIOR ART

The only prior art known to the Applicant is Applicant's own Australian Pat. No. 535952. Otherwise, the Australian Bridgestone Pat. No. 495128 may be referred to for peripheral interest.

BRIEF SUMMARY OF THE INVENTION

The main object of this invention is to reduce costs and reduce usage of timber, and in one embodiment of the invention there is provided a circular metal base, and a circular metal end cover. A plurality of staves arranged circumferentially and lying edge to edge are clamped by a circumferential clamp which retains them in a cylindrical configuration and a tension clamp extends in an axial direction between the base and end cover and clamps the staves between them.

With this invention, use can be made of relatively inexpensive base and end cover panels since they can be formed from light gauge metal (for example 316 grade stainless steel sheet) and the circumferential clamp and axially extending tension clamp can be simple and inexpensive.

Sometimes there is such a tolerance from timber which is produced in a mill that there is the likelihood of variation of length, thickness and width, and in an embodiment of this invention, both the base member and end cover are provided with an annular bearing surface which is somewhat wider than the thickness of the stave, so that the staves can move inwardly or outwardly to accommodate the wide tolerances of thickness and width dimensions which exist, and polymeric (preferably elastomeric) seals between the ends of the staves and the base and end cover will accommodate somewhat less tolerances of length.

BRIEF SUMMARY OF THE DRAWINGS

An embodiment of the invention is described hereunder in some detail, with reference to, and is illustrated in, the accompanying drawings, in which FIG. 3 is a cross-section taken on line 3—3 of FIG. 2, FIG. 4 is a fragmentary enlarged section showing how the staves are clamped edge to edge in the preferred embodiment of FIGS. 1, 2 and 3, FIG. 5 shows an alternative arrangement wherein the stave edges are convex, and FIG. 6 shows a further alternative arrangement wherein the stave edges are concave and convex respectively.

DETAILED DESCRIPTION OF THE PREFERRED EMBODIMENT

Figure 1:
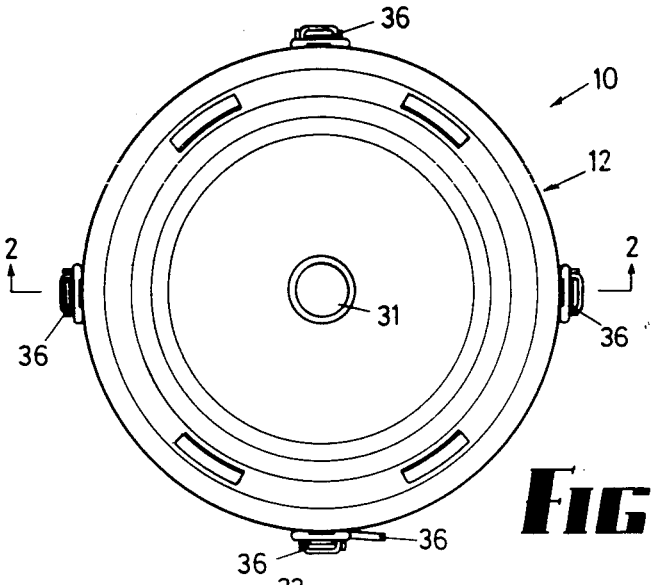
FIG. 1 is a plan view of the wine cask.
Figure 2:
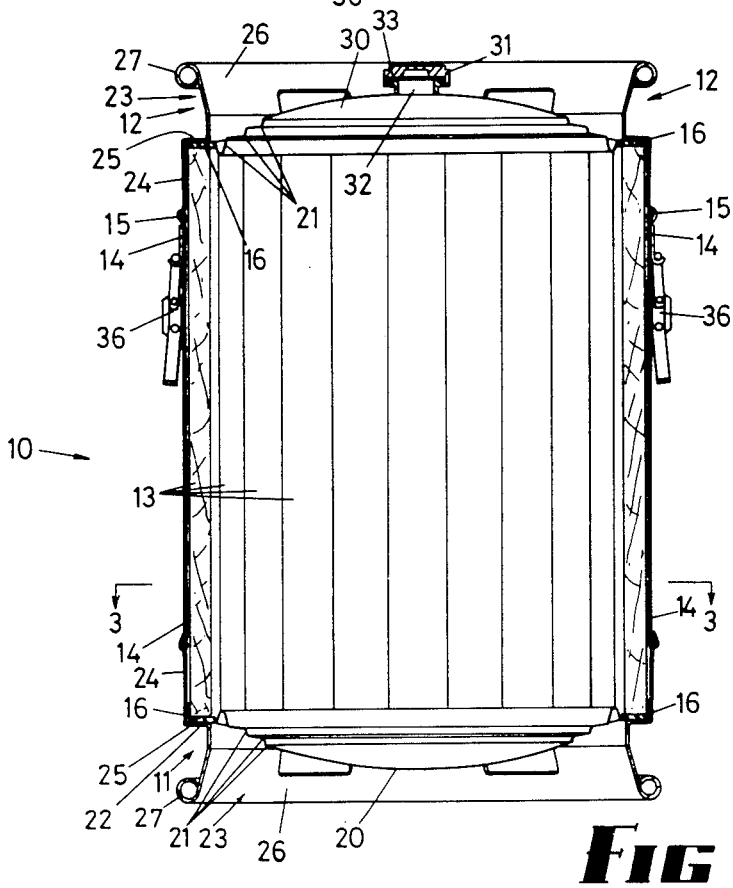
FIG. 2 is a central section taken on line 2—2 of FIG. 1.

In the embodiment of FIGS. 1 to 4, a wine cask 10 comprises a base assembly 11 and an end cover assembly 12, a plurality of oak staves 13 extending in an axial direction therebetween, two circumferential clamp bands 14 retaining the staves with longitudinal edges in edge to edge abutment in a cylindrical configuration, and four tension clamp bands extending in a direction generally parallel to the longitudinal edges of the staves 13, 15 retaining the upper and lower assemblies 12 and 11 together and bearing against respective ends of the staves 13 through annular sealing gaskets 16 of polymeric (preferably elastomeric) material, such as silicone rubber or polyurethane.

The base assembly 11 comprises a base panel 20 of circular shape formed from a suitable grade of stainless steel sheet, the panel containing circumferential corrugations 21 radially spaced from one another so that the panel 20 can function to some extent as a flexible diaphragm. The outer edge of the base panel has an annular surface 22 which carries on it the annular gasket 16.

The base panel assembly also comprises a support ring 23 which is formed from sheet metal (which can be galvanised sheet steel), to have an upwardly directed flange 24 the lower edge of which terminates in a radially inwardly directed shelf 25 which supports the annular portion 22 of the base member, and below the shelf there is a skirt 26 with a roll edge 27 which rests upon the ground.

The end cover assembly 12 is substantially similar to the base assembly 11 both in the shape of its elements and its configuration, and bears similar numerical designations, but in addition the end panel 30 has a drain cap 31 which threadably engages an outlet spout 32, and an O-ring 33 seals between the two and avoids ingress of air.

The facing edges of the two support rings 23 are interconnected by means of the tension clamp bands 15 which are coupled to overcenter type clamps 36, and these tension bands place the staves 13 under compression. The staves are sealed at their respective ends by the gaskets 16. The circumferential flexible clamp bands 14 retain the staves together in a cylindrical configuration, tension also being applied by means of overcenter clamps 36 similar to those used on the tensioning means between the end members.

In the described embodiment, the staves 13 have parallel sides but the edges diverge to form a symmetrical trapezoid in cross-section as shown best in FIG. 4. In this way, the tension on the bands 14 urges the staves into firm sealable engagement with each other, as in the instance of a coopered barrel. Since there is likely to be a wide tolerance range, the radial width of the annular support surfaces 22 on the end members is made considerbly greater than the thickness of the staves, and this feature provides means whereby the tolerance of the stave width can vary by a large amount. However in some embodiments these stave edges are not flat converging edges but are either convex, or alternate convex concave edges, as shown in FIGS. 5 and 6 respectively.

In all instances, the staves have planar sides, and are readily removable so that they can be readily shaved, for example in a wood-working machine, so as to expose fresh timber to the wine for further extraction of wood phenolics.

Consideration of the above embodiment will indicate that the invention is quite simple but nevertheless results in an inexpensive and readily produced cask wherein there is very little wastage of the material used.

I claim:

1. A wine cask having a circular metal base assembly and a circular metal end cover assembly, a plurality of staves located between the base and end cover assemblies with their longitudinal edges in abutment, at least one circumferential clamp extending laterally around the outer circumference of the staves clamping the longitudinal edges of the staves into abutment so that the staves define a generally cylindrical configuration, and tension clamp bands including tension clamps located external to said wine cask and to said base assembly and said end cover assembly attached and extending uninterruptedly along the entire longitudinal dimension of the cask between said base and end cover assemblies in a direction generally parallel to the longitudinal edges of the staves to clamp the staves therebetween, said tension clamps located along said tension clamp bands between said base assembly and said end cover assembly, and operating when engaged to place said staves under compression between said base assembly and said end cover assembly.

2. A wine cask according to claim 1 wherein each of said metal base and end cover assemblies comprises a plurality of circular corrugations and an annular surface.

3. A wine cask according to claim 2 comprising a pair of elastomeric sealing rings abutting respective said annular surfaces and sealably engaging ends of said staves.

4. A wine cask according to claim 1 wherein the sides of the staves are flat.

5. A wine cask according to claim 4 wherein each stave is trapezoidal in shape.

6. A wine cask according to claim 4 wherein the edges of the staves are convex.

7. A wine cask according to claim 4 wherein each stave has one convex and one concave edge.

8. A wine cask according to claim 2 wherein each said assembly comprises a support ring partly overlying a respective said annular surface, and said tension clamps extend between said support rings.

9. A wine cask according to claim 8 wherein each said support ring extends beyond a said assembly and terminates in a roll edge.

10. A wine cask according to claim 1 wherein each said clamp comprises a band and over-center clamp means.

* * * * *